United States Patent [19]

McClay et al.

[11] Patent Number: 4,606,701

[45] Date of Patent: Aug. 19, 1986

[54] TIP STRUCTURE FOR A COOLED TURBINE ROTOR BLADE

[75] Inventors: Augustine C. McClay, Ridley Township, Delaware County; James M. Allen, Marple Township, Delaware County; William E. North, Concord Township, Delaware County, all of Pa.

[73] Assignee: Westinghouse Electric Corp., Pittsburgh, Pa.

[21] Appl. No.: 616,786

[22] Filed: Jun. 1, 1984

Related U.S. Application Data

[63] Continuation of Ser. No. 298,819, Sep. 2, 1981, abandoned.

[51] Int. Cl.[4] ..... F01D 5/18

[52] U.S. Cl. ..... 416/92; 416/97 R

[58] Field of Search ..... 416/92, 95–97

[56] References Cited

U.S. PATENT DOCUMENTS

| | | | |
|---|---|---|---|
| 2,931,624 | 4/1960 | Hyde | 416/92 |
| 2,985,953 | 5/1961 | Eccles | 416/92 |
| 3,301,528 | 1/1967 | Malley | 416/96 |
| 3,443,792 | 5/1969 | Moss | 416/92 |
| 3,635,585 | 1/1972 | Metzler | 416/92 X |
| 3,876,330 | 4/1975 | Pearson et al. | 416/92 |
| 3,885,886 | 5/1975 | Richter | 416/92 X |
| 3,982,851 | 9/1976 | Anderson et al. | 416/97 |
| 3,994,622 | 11/1976 | Schultz et al. | 416/96 A X |
| 4,073,599 | 2/1978 | Allen et al. | 416/97 R |
| 4,390,320 | 6/1983 | Eiswerth | 416/97 R |
| 4,411,597 | 10/1983 | Koffel et al. | 416/92 |
| 4,424,001 | 1/1984 | North et al. | 416/92 |
| 4,497,613 | 2/1985 | Carreno | 416/228 |

*Primary Examiner*—Everette A. Powell, Jr.
*Attorney, Agent, or Firm*—E. F. Possessky

[57] ABSTRACT

The invention comprises a cooled turbine rotor blade having an improved blade tip structure. A groove is provided in the trailing edge end of the blade tip on those turbine blades whose trailing edge is too thin to support an extension of the blade walls to form a blade tip cavity which extends to the tip of the trailing edge of the blade. The groove protects adjoining exhaust apertures from closure by a blade tip smear.

5 Claims, 5 Drawing Figures

TIP STRUCTURE FOR A COOLED TURBINE ROTOR BLADE

This application is a continuation of application Ser. No. 298,819, filed Sept. 2, 1981, now abandoned.

BACKGROUND OF THE INVENTION

The present invention relates generally to combustion turbine rotor blades and more particularly to an improved tip structure for a cooled turbine rotor blade.

It is well established that greater operating efficiency and power output of a combustion turbine may be achieved through higher inlet operating temperatures. Inlet operating temperatures are limited, however, by the maximum temperature tolerable to the rotating turbine blades. Also, as turbine blade temperature increases with increasing inlet gas temperature, the vulnerability of the blades to damage from the tension and stresses which normally accompany blade rotation increases. Cooling the turbine blades, or forming the turbine blades from a temperature resistant material, or both, permits an increase in inlet operating temperatures while keeping turbine blade temperature below the maximum specified operating temperature for the blade material.

In a typical prior art combustion turbine, cooling air drawn from a compressor section of the turbine is passed through channels in the turbine rotor to each of several rotor discs. Passageways within each rotor disc communicate the cooling air from the turbine rotor to a blade root at the base of each turbine blade. Generally, the cooling air flows from the blade root through an airfoil portion of the blade and exits at least partially through the tip of the blade.

A typical prior art blade tip structure defines an outwardly facing cavity formed by a radially outward extension of the blade wall surrounding the exterior surface of the blade tip. Cooling air exits from apertures in the exterior surface of the blade tip into the cavity. The tip cavity structure prevents sealing of individual exhaust apertures by a minor contact between the blade tip and the surrounding turbine casing. Such a blockage, or blade tip smear, could result in burning of the turbine blade due to reduced cooling air flow through the blade. The prior art includes two different blade tip cavity structures, the choice of structure depending upon the blade row in which the blade is positioned. Generally, the blade geometry varies with each row of turbine blades.

One geometric variable is the thickness of the turbine blade trailing edge the thickness typically decreasing by row in the downstream direction. In initial turbine blade rows the trailing edge is thick enough to support an extension of the blade wall so that the blade tip cavity extends over the trailing edge to cover the entire exterior blade tip surface. In this configuration all apertures in the exterior blade tip surface vent cooling air into the cavity. A portion of the blade wall toward the trailing edge of a convex side of the blade is removed to provide a cooling air exit path from the blade tip cavity. This structure is described in greater detail in Swiss Pat. No. 225,231 and U.S. Pat. No. 3,635,585.

In downstream blade rows, where the thickness of the trailing edge becomes too thin to support an extension of the blade wall, the blade tip cavity must terminate at some point short of the trailing edge of the blade. With no cavity to protect the apertures in the blade tip surface at the trailing edge, an alternate means must be devised to prevent the apertures outside the cavity from being sealed by a blade tip smear.

In typical prior art, a window or notch is structured in the concave side of the trailing edge of the blade so that the cooling air exits from apertures which are recessed from the radially outermost point on the blade tip surface. The window in the trailing edge effectively prevents the exhaust apertures therein from being closed by a blade tip smear, but does so at a cost to the efficiency of the turbine blade. The window removes a portion of the working surface on the concave side of the blade, thereby reducing blade efficiency.

It would be advantageous to design a turbine blade with tip structure at the trailing edge which effectively prevents closure of cooling air apertures outside the tip cavity by blade tip smearing but does not detract from turbine blade efficiency by removal of a portion of the blade wall.

SUMMARY OF THE INVENTION

Accordingly, a cooled turbine rotor blade is provided wherein the turbine rotor blade has an improved blade tip structure which protects cooling air exhaust apertures in the trailing edge end of the blade tip from closure as a result of contact between the blade tip and the outer annulus of a turbine casing. Protection of the exhaust apertures from a blade tip smear is accomplished without diminishing the performance efficiency of the turbine blade. The improved blade tip structure comprises an axially extending, outwardly facing groove in the trailing edge end of the blade tip. Each aperture in the trailing edge end of the tip adjoins and is in flow communication with the groove. Alternatively, the improved blade tip structure comprises an outwardly facing opening surrounding and adjoining an aperture in the trailing edge and of the blade tip. The width and depth of the opening are chosen so as to minimize the risk of aperture closure due to a blade tip smear.

DESCRIPTION OF THE PREFERRED EMBODIMENT

Figure 1:
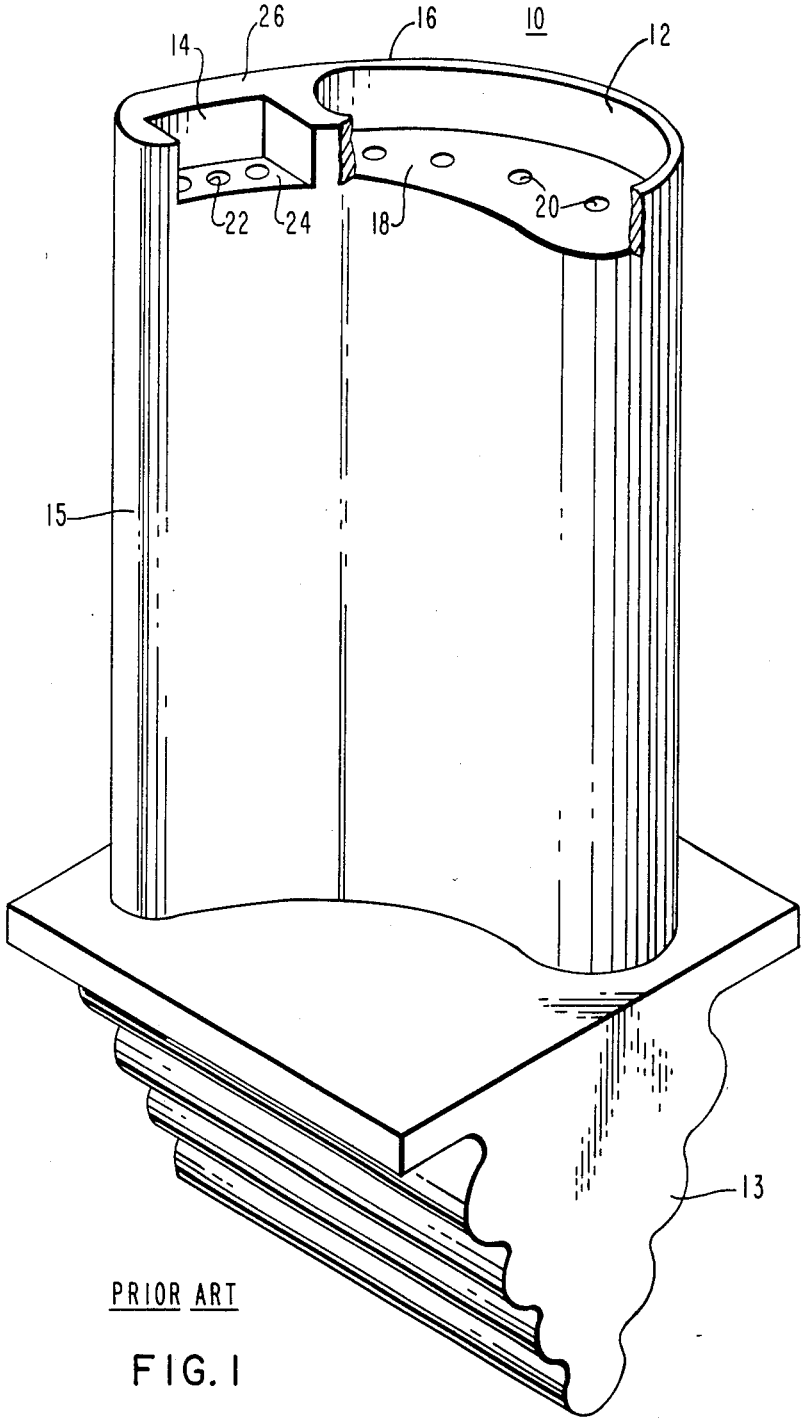
PRIOR ART FIG. 1
FIG. 1 shows an upper airfoil portion of a typical prior art rotor blade with a blade tip cavity and a trailing edge window.

FIG. 1 shows a typical prior art turbine rotor blade. The turbine rotor blade comprises a root portion 13 which interlocks with a turbine disc (not shown) and an airfoil portion 15, having a concave side and a convex side, which intercepts hot gases, converting the motive energy of the gases into rotation of the turbine disc. The blade further comprises a tip portion 10.

The blade tip 10 comprises two distinct structures: a blade tip cavity 12 and a trailing edge window 14. The blade tip cavity 12 is an outwardly facing (relative to a turbine rotor axis) cavity formed by the outward extension of the blade wall 16 around the exterior surface 18 of the blade tip. The cavity 12 terminates short of the trailing edge end of the blade tip, where the blade is too thin to support an extension of the blade wall as shown at 16. Cooling air which enters the blade at the base of the root portion 13 flows through cooling channels in the root portion and the airfoil portion 15 and exits through apertures 20 into the blade tip cavity. Cooling air in the blade tip cavity 12 flows past a clearance (not shown) between the extended blade wall 16 surrounding the cavity and an outer annulus of the turbine casing (not shown) into an exhaust path of gases driving the turbine.

The trailing edge window 14 in the concave side of the turbine blade is a notch-like depression permitting the exit of cooling air through one or more apertures 22 positioned in an outwardly facing surface 24 at the base of the window. The window structure ensures against sealing of the trailing edge apertures by minor contact between the trailing edge tip 26 and the outer annulus of the turbine casing (not shown). The window structure 14 performs the protection function quite well, but detracts from blade performance by removing a section of the blade wall.

In accordance with the principles of the invention, a turbine rotor blade having a trailing edge which is too thin to define a blade tip cavity is structured to prevent sealing of cooling air exhaust apertures by a blade tip smear. The improvement is implemented without reduction of the surface area of the blade wall and resultant decrease in blade efficiency.

Figure 2:
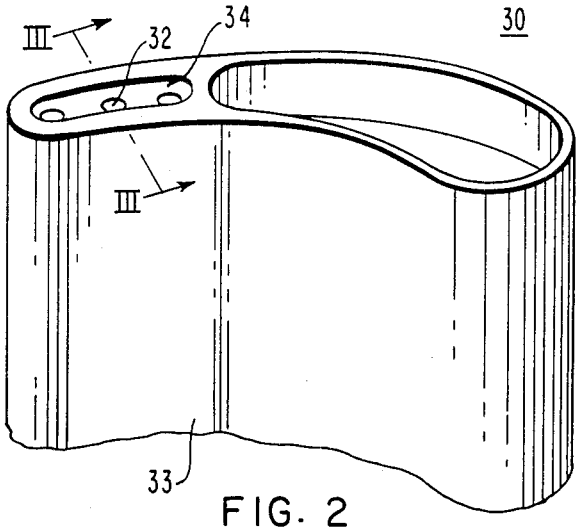
FIG. 2 shows a portion of the tip of a turbine rotor blade structured according to the principles of the invention with a groove along the trailing edge of the tip.
Figure 3:
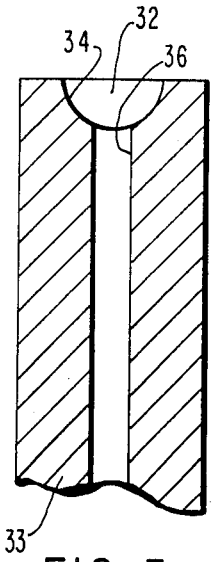
FIG. 3 shows a sectional view of the trailing edge of the blade depicted in FIG. 2.

More particularly, FIG. 2 discloses a preferred embodiment 30 of the invention wherein each of several outside apertures 32 in the trailing edge 33 of the blade tip are connected by means of a single outwardly facing, axially extending groove, or channel 34. FIG. 3 shows a cross-sectional view of the trailing edge of the blade tip 30 depicted in FIG. 2. As is revealed therein, the groove 34 has a U-shaped or circular cross-section with the groove diameter slightly larger than the diameter of the adjoining cooling air exhaust channel 36. The depth of the groove 34 preferably is less than the depth of the adjacent main blade tip cavity as shown in FIG. 2.

The embodiment of the invention depicted in FIGS. 2 and 3 ensures that a minor rub at the trailing edge 33 of the blade tip surface will not seal an outside cooling air exhaust aperture 32. Should a portion of the blade tip be smeared across an outside aperture 32, the recess defined by the groove provides a flow path from the outside aperture 32 immediately beneath the smear to the exterior of the blade. In this way a continuous flow of cooling air is assured and an accumulation of heat within the airfoil portion of the turbine blade, which heat might destroy the turbine blade, is avoided.

The invention is not to be limited to the U-shaped cross-section of the groove depicted in FIG. 3. It is anticipated that the groove may be formed in any of a variety of cross-sectional shapes, the preferred feature being the provision of a flow path in the event of a blade tip smear. The width and depth of the groove may also vary from that depicted in FIG. 3 so as to adjust for the amount of material which might be deposited by a blade tip smear.

Figure 4:
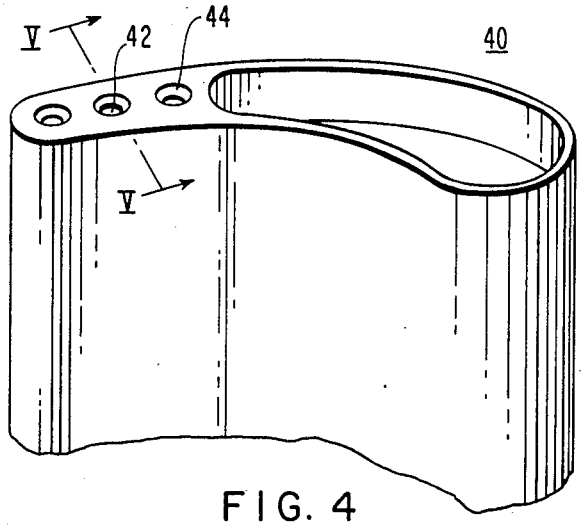
FIG. 4 shows a portion of a blade tip structured in an alternative embodiment according to the principles of the invention with flared edges around apertures in the trailing edge of the blade tip.
Figure 5:
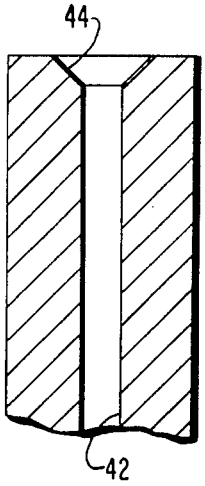
FIG. 5 shows a sectional view of a trailing edge of the turbine blade depicted in FIG. 4.

A second embodiment 40 of the invention is disclosed in FIGS. 4 and 5. The outside apertures 42 in the trailing edge of the tip of the blade are not connected by any means such as in the prior embodiment of the invention. Rather, each individual apertures 42 is structured to minimize the risk of closure by a blade tip smear. The protection function is accomplished by flaring the opening to a countersink configuration 44 as revealed in FIG. 5. The maximum width and depth of each opening 44 may be varied as necessary according to the position of the outside aperture on the trailing edge of the tip and according to the degree of potential contact with the turbine casing. However, as in the case of FIG. 2, it is preferred that the depth of the countersinks 44 be less than the depth of the main blade tip cavity as shown in FIG. 4.

Implementation of the invention will improve performance of the turbine rotor blades by increasing the working surface area on the concave side of the blades. The improvement and performance efficiency is expected to be on the order of 1%, which is quite significant for a single improvement in turbine blade structure.

What is claimed is:

1. A turbine rotor blade having a root portion for securing the blade in a rotor disc, an airfoil portion contoured to define concave and convex sides for intercepting the flow of hot motive gases, air channels within the root and airfoil portions for supporting the flow of cooling air therethrough, and a tip portion structured to provide an exhaust path for cooling air from the airfoil portion, said tip portion comprising:

an outwardly facing cavity defined substantially by an outward radial extension of blade walls;

a trailing edge end of said tip portion being too thin to support blade wall extension, so that said cavity cannot extend to the trailing edge end of said tip portion;

apertures in the exterior surface of said tip portion within said cavity for venting cooling air from the airfoil portion into said cavity;

at least one aperture in the exterior surface of said edge end of said tip portion outside said cavity; and means for recessing said outside aperture from the exterior surface of said tip end portion to a depth less than the depth of said cavity so as to maintain the structural integrity of the tip end portion, so that an outside aperture is not sealed by a blade tip smear.

2. A turbine rotor blade according to claim 1 wherein a plurality of outside apertures are provided and said recessing means comprises an outwardly facing, axially extending groove in the exterior surface of said tip end portion, adjoining and in flow communication with each of said outside apertures.

3. A turbine rotor blade according to claim 2 wherein said groove has a U-shaped cross-section with a width which exceeds the diameter of said outside apertures.

4. A turbine rotor blade according to claim 1 wherein a plurality of outside apertures are provided and said recessing means comprises an individual, outwardly facing opening surrounding, adjoining and in flow communication with each of said outside apertures.

5. A turbine rotor blade according to claim 4 wherein each of said openings has walls tapered in a countersink configuration so that the diameter of each of said openings at the exterior surface of said tip portion exceeds the diameter of said outside apertures.

* * * * *